United States Patent [19]

Mathey

[11] Patent Number: 4,903,606

[45] Date of Patent: Feb. 27, 1990

[54] MINE HAVING A SENSOR WITH IMPROVED RIGHTING CHARACTERISTIC AFTER MINE LAYING

[75] Inventor: Christoph Mathey, Ockenfels, Fed. Rep. of Germany

[73] Assignee: Dynamit Nobel Aktiengesellschaft, Troisdorf, Fed. Rep. of Germany

[21] Appl. No.: 378,274

[22] Filed: Jul. 11, 1989

[30] Foreign Application Priority Data

Jul. 16, 1988 [DE] Fed. Rep. of Germany ..... 3824207

[51] Int. Cl.[4] ..... F41B 23/24

[52] U.S. Cl. ..... 102/401; 102/427

[58] Field of Search ..... 102/401, 424, 427

[56] References Cited

U.S. PATENT DOCUMENTS 3,754,508 8/1973 Dalton ..... 102/427

4,292,861 10/1981 Thornhill, Jr. et al. ..... 102/401

FOREIGN PATENT DOCUMENTS 3424888 2/1986 Fed. Rep. of Germany ..... 102/427

*Primary Examiner*—Charles T. Jordan

*Attorney, Agent, or Firm*—Antonelli, Terry & Wands

[57] ABSTRACT

By replacing a round sensor wire capable of effecting, by the formation of a spiral spring, the righting of a sensor wire on a mine after laying by a wire having a rectangular cross section wherein the larger sides of the rectangle of the cross-sectional area of the sensor wire form essentially a right angle with a radius vector of the cylindrical supporting member, the righting force of the sensor wire is considerably enhanced as compared with a round wire although the wire still remains sufficiently elastic to be windable around the mine without permanent deformation.

2 Claims, 1 Drawing Sheet

MINE HAVING A SENSOR WITH IMPROVED RIGHTING CHARACTERISTIC AFTER MINE LAYING

This invention relates to a land mine with an essentially cylindrical supporting member exhibiting a continuously extending guide track open in the axial direction, and to an elastic sensor wire positioned in the guide track during laying of the mine, this wire being shaped at one end in the manner of a spiral spring and being attached to the supporting member via an inner end of the spiral spring.

A conventional sensor system in a mine (DE 3,424,888 Al) comprises as its essential part a sensor wire with a circular cross section, this wire projecting in the upward direction after laying and righting of the mine. An object touching the sensor wire, for example, a vehicle, evokes vibrations in the sensor wire; a mechanical-electrical transducer produces an electrical signal therefrom and, once a minimum value has been exceeded, ignition of the mine is brought about.

During installation into a transport, storage, or laying device, the sensing or main portion of the sensor wire is wound for reasons of compactness, into a guide track around the mine housing. A spiral spring is provided between the main portion of sensor wire and the mine housing, this spiral spring consisting of an end of the sensor wire, i.e. an end portion of the sensor wire assumes the function of a power element. The spiral spring is tensioned when the sensor wire is wound up into the guide track, and once the sensor wire is released in the guide track, the spring causes righting of the sensor wire into the operative position.

The unwinding and righting of the sensor wire can be impeded in the terrain, for example, by shrubbery. Increasing the rigidity of the spring by means of a different material is hardly possible since a material having a high modulus of elasticity is employed anyway in order to be able to keep the wire diameter small for space reasons. Enlargement of the sensor wire diameter by a larger wire thickness cannot be considered and realized since otherwise the sensor wire could no longer be wound around the housing into the guide track without permanent deformation.

Attempts have been made to enhance righting of the sensor wire by joining, at the end of the sensor wire in the region of the spiral, another wire of the same material (auxiliary wire) side-by-side with the actual sensor wire, but this also means that twice as much room is needed in the zone of the spiral; this is extremely undesirable due to specifications. Also, there is an unavoidable enlargement of the spiral spring thickness which has a disadvantageous effect on the diameter of the mine.

The invention is based on the object of improving the righting of the wound up sensor wire within the scope of the dimensions determined by the mine. This object has been attained by providing that the cross section of the sensor wire is rectangular, especially in the region of the spiral, the larger or longer rectangle sides of the cross-sectional area of the sensor wire forming essentially a right angle with a radius vector of the cylindrical supporting member forming a housing for the mine.

Based on the wire cross section as modified by the invention, a greater spring force for righting the sensor wire is available as compared with a round wire. The manufacturing cost is lower than in case of reinforcement by means of an auxiliary wire and two spirals. The power to right the sensor wire extends, for each point of the spiral, respectively, in a plane lying perpendicularly to a radius vector of the cylindrical supporting member at this point. The expansion of the spiral in the direction of the radius vector has no effect on the righting operation. According to the invention, the smaller sides of the rectangular cross-sectional area of the sensor wire are to lie in this direction, and the dimensions here are preferably equal to the diameter of the heretofore known sensor wire with a circular cross section. The outer diameter of the guide track on the supporting member of the mine thus need not be enlarged; the somewhat larger dimensions in the axial direction do not interfere. Since the dimensions in the radial direction have not been altered, the edge stress during winding around the supporting member has also remained approximately the same, and windup of the sensor wire on the mine body in the guide track has not become more difficult. During this winding around and winding up procedure, the sensor wire is to be deformed merely elastically. In contrast thereto, the spring rigidity is considerably increased by an enlargement of the larger sides of the rectangular cross-sectional area of the sensor wire. An estimate by way of the geometrical moments of inertia shows that, if the righting power in case of a rectangular wire cross section is to be equal to that in case of two juxtaposed wires with a respectively round cross section, the linear dimension in the direction of the radius of the supporting member (thickness of spiral spring) is practically halved.

A person skilled in the art is aware of the fact that, in an exact comparison of the mechanical properties of wires having a round cross section and a rectangular cross section, additional influences must be taken into account, for example that the permissible bending stress in case of rectangular wire is less by about 12% than in case of a round wire of the same material; or that the bending resistance moments are somewhat different; however, such effects represent relatively small corrections as compared with the considerable gain in spring stiffness, based on the linear dimension.

The invention is illustrated in the accompanying drawings and further described by way of a preferred embodiment. The drawings show the invention, schematically and on an enlarged scale, wherein.

Figure 1:
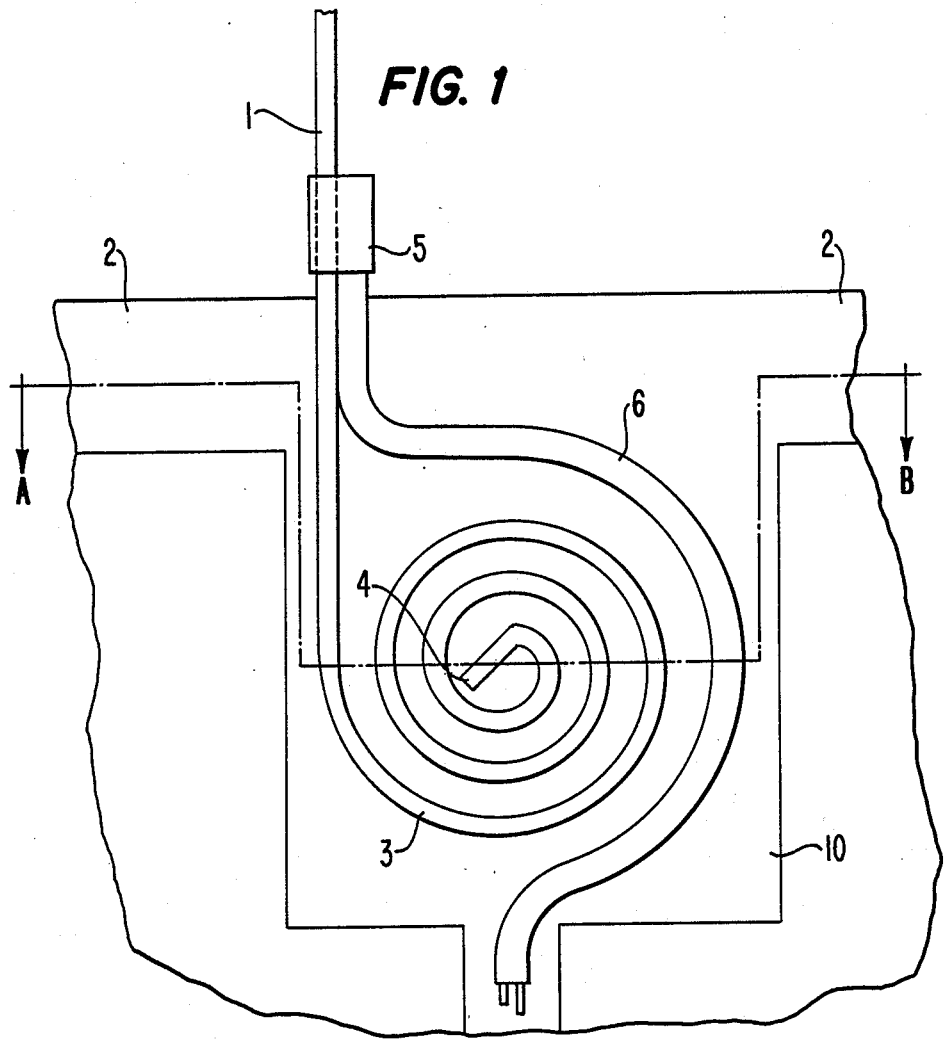
FIG.1 is a righted sensor wire with spiral end attached to a mine.

FIG. 1 shows a top view of the righted sensor wire 1, illustrated from a side of the mine. During transport and during laying, the sensor wire 1 is wound about a guide track 2 running around the mine. Elements that restrain and release the sensor wire are conventional and are not included in the illustration. At the end on the mine side, the sensor wire forms a spiral 3. The end 4 of the spiral 3 is affixed to the mine and is located within the guide slot 10. The schematic illustration also shows the vibration pickup 5, by way of which the mechanical vibrations in the sensor wire are converted into electrical signals which act, via the line 6, on a mine detonator unit (not shown).

The cross-sectional area of the sensor wire 1, especially in the zone of the spiral 3 is a characteristic of the invention; namely, the wire cross section is rectangular. The larger sides of the two sides of the rectangular cross-sectional area of the sensor wire are to form a right angle with the radius vector of the cylindrical rotary member. In other words, in FIG. 1, the larger or longer sides of the two sides of the rectangle are located, respectively, in or parallel to the plane of the drawing while the smaller sides, just as the radius vector, extend perpendicularly to the plane of the drawing. This situation can also be seen especially from FIG. 2; the latter represents a section taken along line A-B according to FIG. 1 through the spiral 3.

Figure 2:
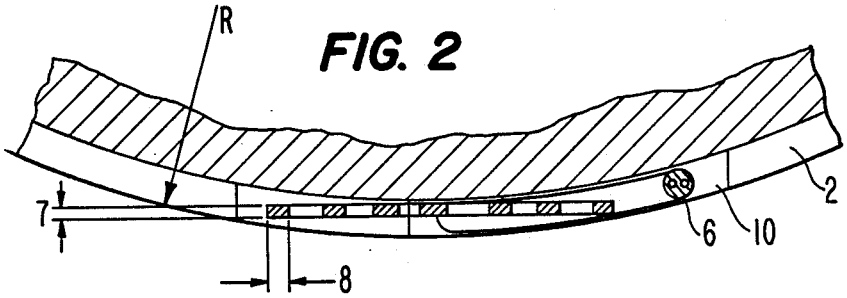
FIG. 2 is a section through the spiral along line A-B according to FIG. 1.

The "radial" thickness 7 of the wire is about 0.9 mm; whereas, the length of the larger side 8 of the two rectangular sides of the cross-sectional area of the sensor wire 1 has a value of about 1.3 mm, as can be seen from FIG. 2. The wire 1 consists of a spring steel.

An estimate reveals that a round sensor wire of the same thickness, with an equally sized auxiliary wire, would require a spiral spring thickness of about 2.0 mm.

What is claimed is:

1. A mine comprising an essentially cylindrical supporting member having a continuously extending guide track open in the axial direction, and an elastic sensor wire wound up in the guide track during laying of the mine, said sensor wire being shaped in the manner of a spiral spring at one end and being attached at said one end to the supporting member via an inner end of the spiral spring, characterized in that the cross section of the sensor wire is rectangular, especially in the zone of the spiral spring, the larger sides of the rectangular cross-sectional area of the sensor wire forming essentially a right angle with a radius vector of the cylindrical supporting member.

2. The mine according to claim 1, wherein the one end of the sensor wire comprising the spiral spring is located within a guide slot extending from the guide track along a curved surface of the cylindrical support member; the guide slot having the same radial thickness as the guide track.

* * * * *